US005544461A

United States Patent [19]

Sommerstein

[11] Patent Number: 5,544,461

[45] Date of Patent: Aug. 13, 1996

[54] PANEL MOUNTING STRUCTURE

[76] Inventor: Michael Sommerstein, 75 Green Acres Road, Thornhill, Ontario L4J 4S2, Canada

[21] Appl. No.: 315,387

[22] Filed: Sep. 30, 1994

[51] Int. Cl.[6] ..... E04H 1/00

[52] U.S. Cl. ..... 52/235; 52/509; 52/512; 52/510

[58] Field of Search ..... 52/235, 509, 510, 52/512

[56] References Cited

U.S. PATENT DOCUMENTS

| | | | |
|---|---|---|---|
| 2,104,085 | 1/1938 | Leland | 52/509 |
| 3,266,207 | 8/1966 | Birum, Jr. | 52/235 |
| 3,621,635 | 11/1971 | De Lange | 52/235 |
| 3,858,375 | 1/1975 | Silvernail | 52/235 |
| 3,936,986 | 2/1976 | Steel | 52/235 |
| 4,552,790 | 11/1985 | Francis | 52/235 |
| 4,597,235 | 7/1986 | Olsen | 52/235 X |

*Primary Examiner*—Wynn E. Wood
*Assistant Examiner*—W. Glenn Edwards
*Attorney, Agent, or Firm*—Ridout & Maybee

[57] ABSTRACT

A plurality of vertically adjacent panels each has an upper edge portion and a lower edge portion, a support being provided for mounting the upper edge portion of each panel and the lower edge portion of the upwardly adjacent panel. The upper edge portion of the panel has a downwardly open hook in engagement with an upstanding rib of the support, and the lower edge portion of the upwardly adjacent panel has a further downwardly open hook in engagement with a further upstanding rib of the support, thereby to provide mounting on the support of the upper edge portion of the panel and the lower edge portion of the upwardly adjacent panel. The hook of the upper edge portion of the panel extends above the lower edge of the upwardly adjacent panel.

8 Claims, 4 Drawing Sheets

PANEL MOUNTING STRUCTURE

This invention relates to a panel mounting structure comprising a plurality of vertically adjacent panels removably mounted on supports which are, in turn, mounted on, for example, a building structure so that the panels constitute a cladding for the building structure, the panel mounting structure of the present invention being particularly applicable where the panels are of relatively lightweight sheet aluminum or steel form.

It is a primary object of the present invention to provide such a panel mounting structure which is relatively simple and inexpensive to manufacture and install and in which the mounting and removal of the panels is likewise simple and can be performed expeditiously without any special skills and without the use of any tools, the panel mounting structure permitting each panel to be mounted and removed without disturbing adjacent panels so that, for example, a damaged panel may readily be replaced without the need to disturb panels adjacent to the damaged panel.

A panel mounting structure in accordance with the present invention comprises a plurality of vertically adjacent panels each having an upper edge portion and a lower edge portion, and supports each of which is for mounting the upper edge portion of one of the panels and the lower edge portion of the upwardly adjacent panel. Each support has a vertically extending panel upper edge engagement member and a vertically extending panel lower edge engagement member, and said upper edge portion of said one of the panels has a vertically extending support engagement member which is vertically movable by vertical movement of said one of the panels into and out of engagement with said panel upper edge engagement member of the support without vertical movement of the upwardly adjacent panel, and said lower edge portion of the upwardly adjacent panel has a vertically extending support engagement member which is vertically movable by vertical movement of the upwardly adjacent panel into and out of engagement with said panel lower edge engagement member of the support without vertical movement of said one of the panels, thereby to provide said mounting on the support of the upper edge portion of said one of the panels and the lower edge portion of the upwardly adjacent panel with the upper edge portion and the lower edge portion of each panel being so mountable on the respective supports without disturbing the mounting of the vertically adjacent panels. The support engagement member of the upper edge portion of said one of the panels extends above the lower edge of the upwardly adjacent panel.

In order that the invention may be more clearly understood and more readily carried into effect the same will now, by way of example, be more fully described with reference to the accompanying drawings in which FIG. 1 is an elevational view of a panel mounting structure according to a preferred embodiment of the invention;

Figure 1:
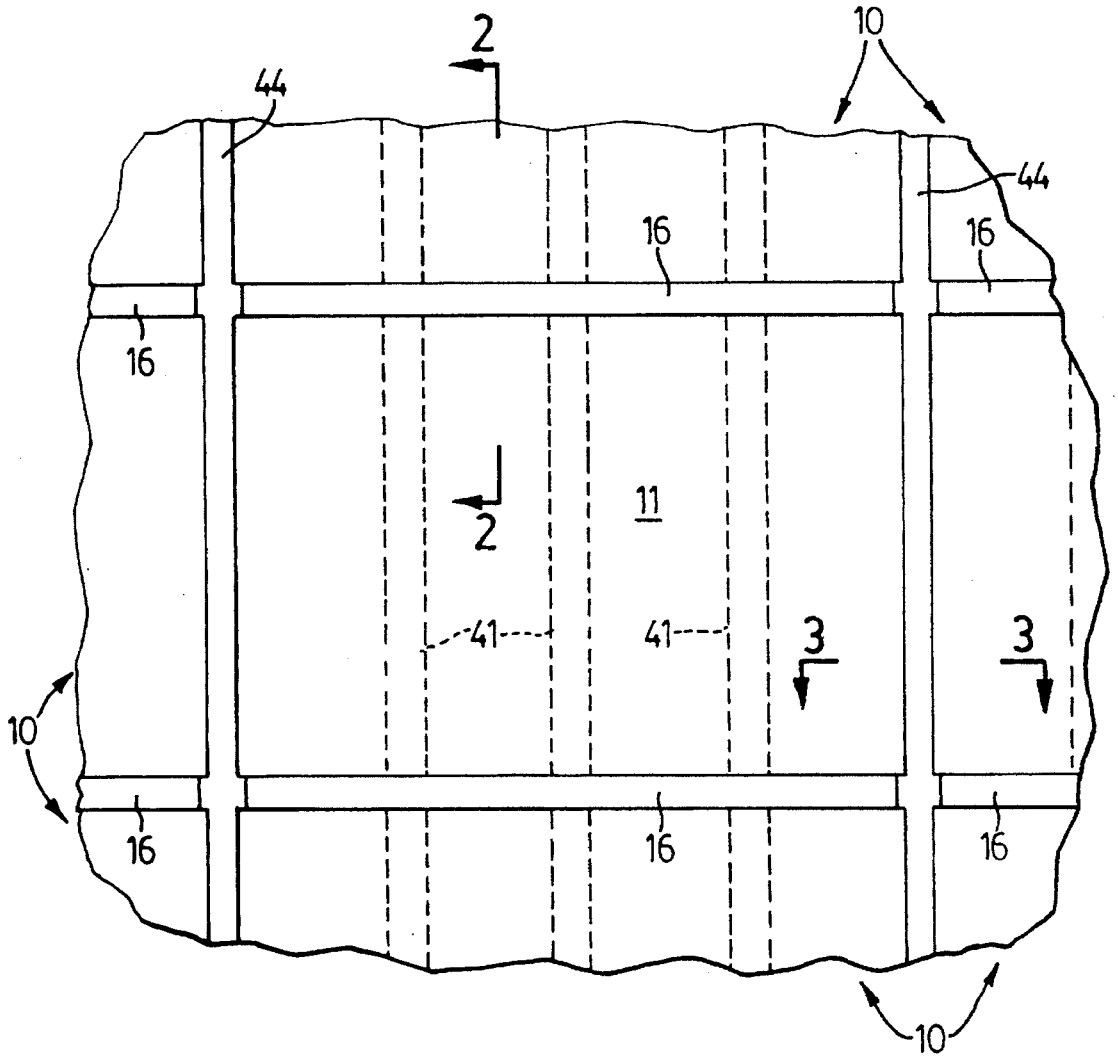

Referring to the drawings, 10 denotes generally each of a plurality of panels, with each panel 10 comprising an outer portion 11 of rectangular form, two opposed inwardly bent side portions 12, an inwardly bent lower portion 13, and an inwardly bent upper portion 14, the inner edge portion of the lower portion 13 being bent to form a downwardly open hook 15 which constitutes a vertically extending support engagement member, and the inner edge portion of the upper portion 14 likewise being bent to form a downwardly open hook 16 which constitutes a further vertically extending support engagement member. An upper part of each side portion 12 is constituted by a triangularly shaped part 17 which is downwardly bent from the upper portion 14, with an angled line of separation 18 between this part 17 and the remainder of the associated side portion 12. Each panel 10 as hereinabove described is preferably formed from a unitary aluminum or steel sheet which is formed and bent, as described above, to provide the outer portion 11, the side portions 12 including the parts 17, the lower portion 13, and the upper portion 14, the present invention being particularly applicable where the sheet is of relatively lightweight aluminum or steel. Thus, for example, the sheet may be of aluminum of 0.063 inch thickness.

A support denoted generally by the reference numeral 19 is provided for the mounting of the upper edge portion of each panel 10 and the lower edge portion of the upwardly adjacent panel 10, this support 19 which is preferably of extruded form having an upstanding rib 20 which constitutes a vertically extending panel upper edge engagement member and with which the hook 16 is operatively engaged thereby to mount the upper edge portion of the panel 10. The support 19 also comprises an upstanding rib 21 which constitutes a vertically extending panel lower edge engagement member and with which the hook 15 of the upwardly adjacent panel 10 is operatively engaged thereby to mount the lower edge portion of this upwardly adjacent panel 10, the support 19 being, in turn, mounted on, for example, a supporting girt or panel 22 of a building structure by means of at least one attachment bracket 23. The attachment bracket 23 may comprise two L-shaped members 24 and 25 with a limb 26 of the member 24 overlying a limb 27 of the member 25 and being secured thereto by screws 28. The remaining limb 29 of the member 25 is secured to the panel 22 by screws 30, and the support 19 is secured to the remaining limb 31 of the member 26 by screws 32, separation tapes 33 and 34 being, if required, disposed between the limb 29 of the member 25 and the panel 22 and between the limb 31 of the member 24 and the support 19 to prevent electrolytic action therebetween. Each screw 28 may be disposed through an elongated slot 35 in the limb 26 of the member 24 to permit adjustment of the spacing of the support 19 from the panel 22, this spacing of the support 19 from the panel 22 being, if desired, occupied by insulation material 36.

Within each upper corner of the panel 10 there is preferably provided a right-angled reinforcement bracket 37 which may be secured by an epoxy adhesive 38, one limb of each bracket 37 being secured to the inner face of the portion 11 and the other limb of each bracket 37 being secured to the associated side portion 12 overlapping the line of separation 18 between the part 17 and the remainder of the side portion 12. Furthermore, right-angled reinforcement brackets 39 are preferably secured by, for example, an epoxy adhesive 40 within the lower corners of each panel 10, one limb of each bracket 39 being secured to the lower portion 13 and the other limb of each bracket 39 being secured to the associated side portion 12.

Figure 4:
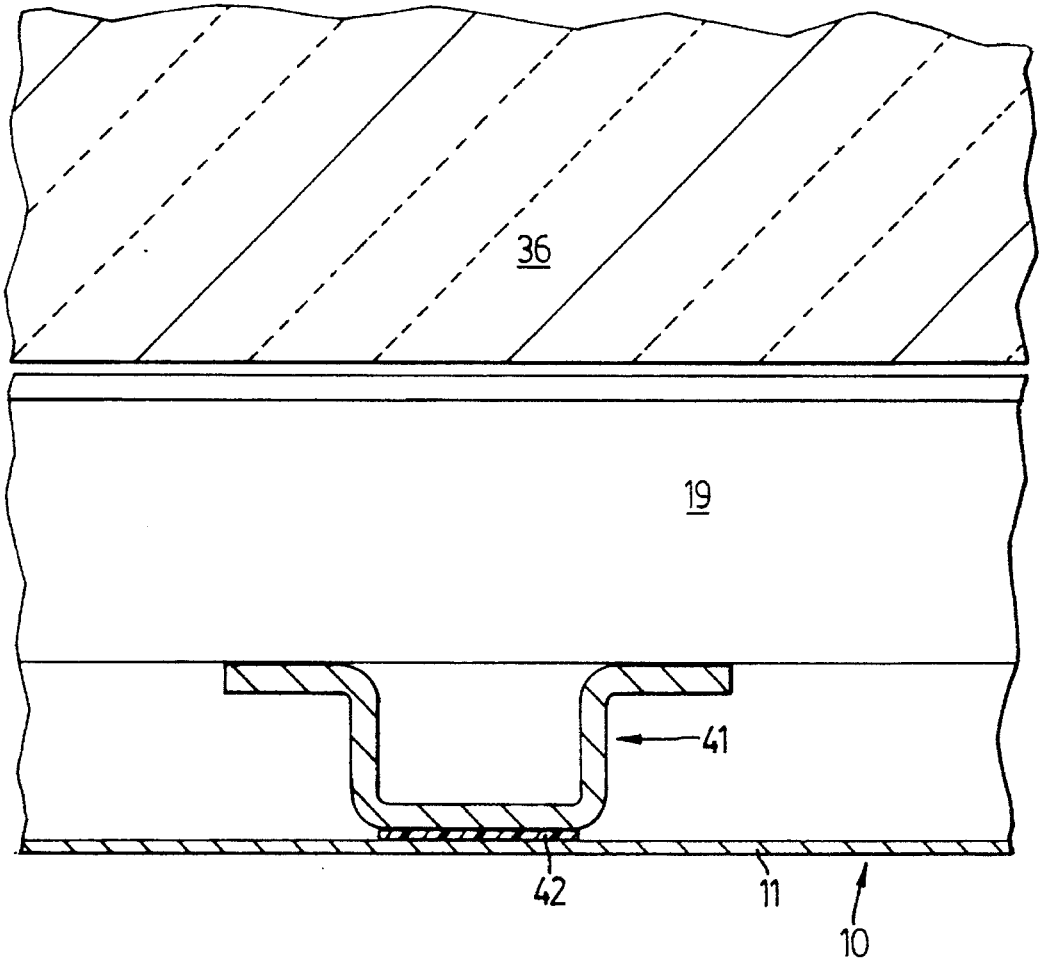
FIG. 4 is a sectioned view, again on the same enlarged scale as FIG. 2, on the line 4—4 in FIG. 2.

One or more vertical stiffeners 41 each of which may be of top-hat transverse cross-section as shown in FIG. 4 may be secured in spaced relationship on the inner face of the outer portion 11 of each panel 10 by means, for example, of double-sided adhesive tape 42. These stiffeners 41 are operatively in abutting contact with a downwardly outer flange 43 of the support 19.

Figure 3:
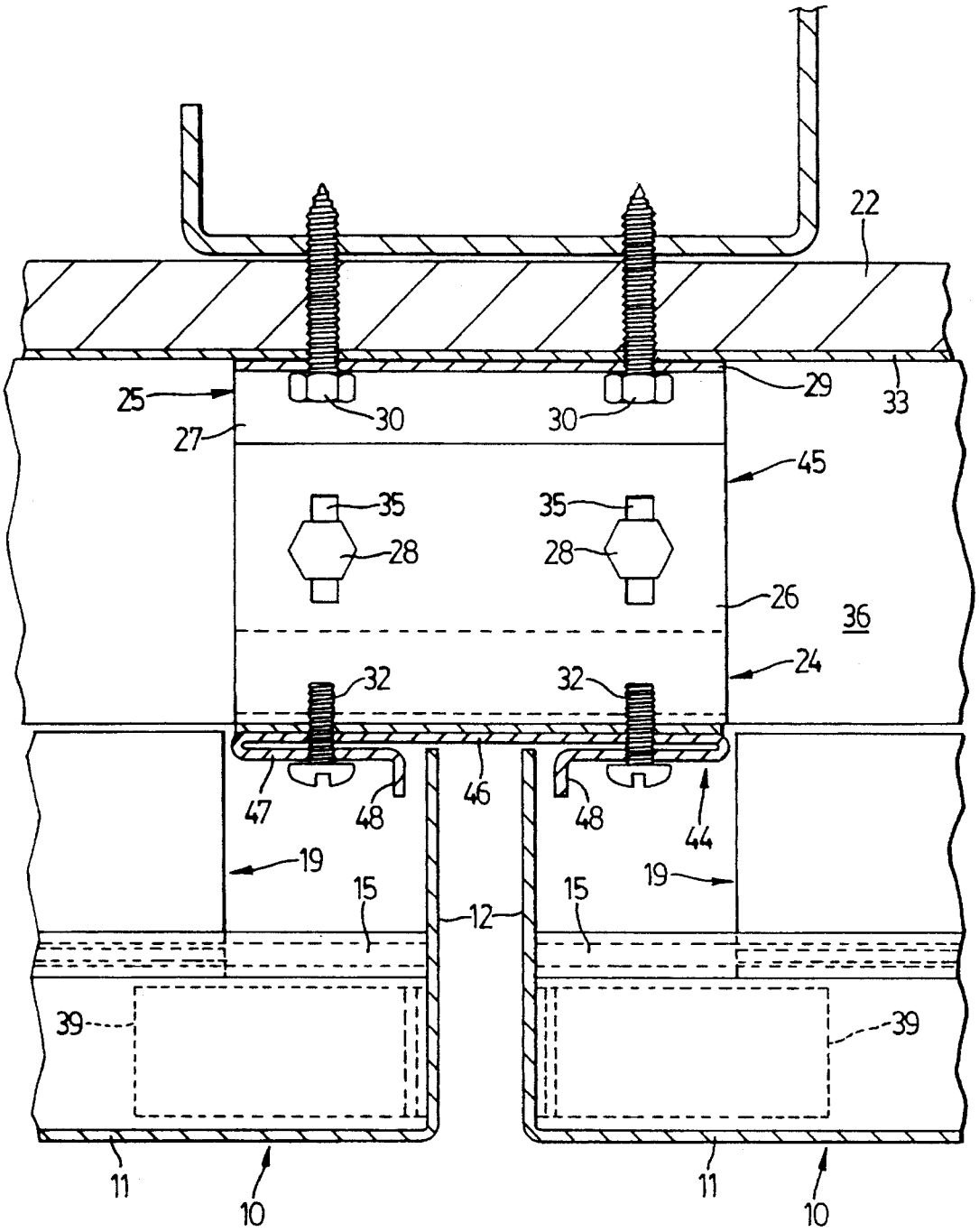
FIG. 3 is a sectioned view, on the same enlarged scale as FIG. 2, on the line 3—3 in FIG. 1.

As shown in FIG. 3, vertically extending gutters 44 are each mounted on the panel 22 by means of a plurality of vertically spaced attachment brackets 45 which may each correspond to the attachment bracket 23, the parts of the attachment bracket 45 being denoted by the same reference numerals as the corresponding parts of the bracket 23. The gutter 44 comprises an inner portion 46, and reflexly bent side portions 47, the edge portions 48 of which are outwardly directed with the side portions 12 of horizontally adjacent panels 10 being disposed between these edge portions 48.

Figure 2:
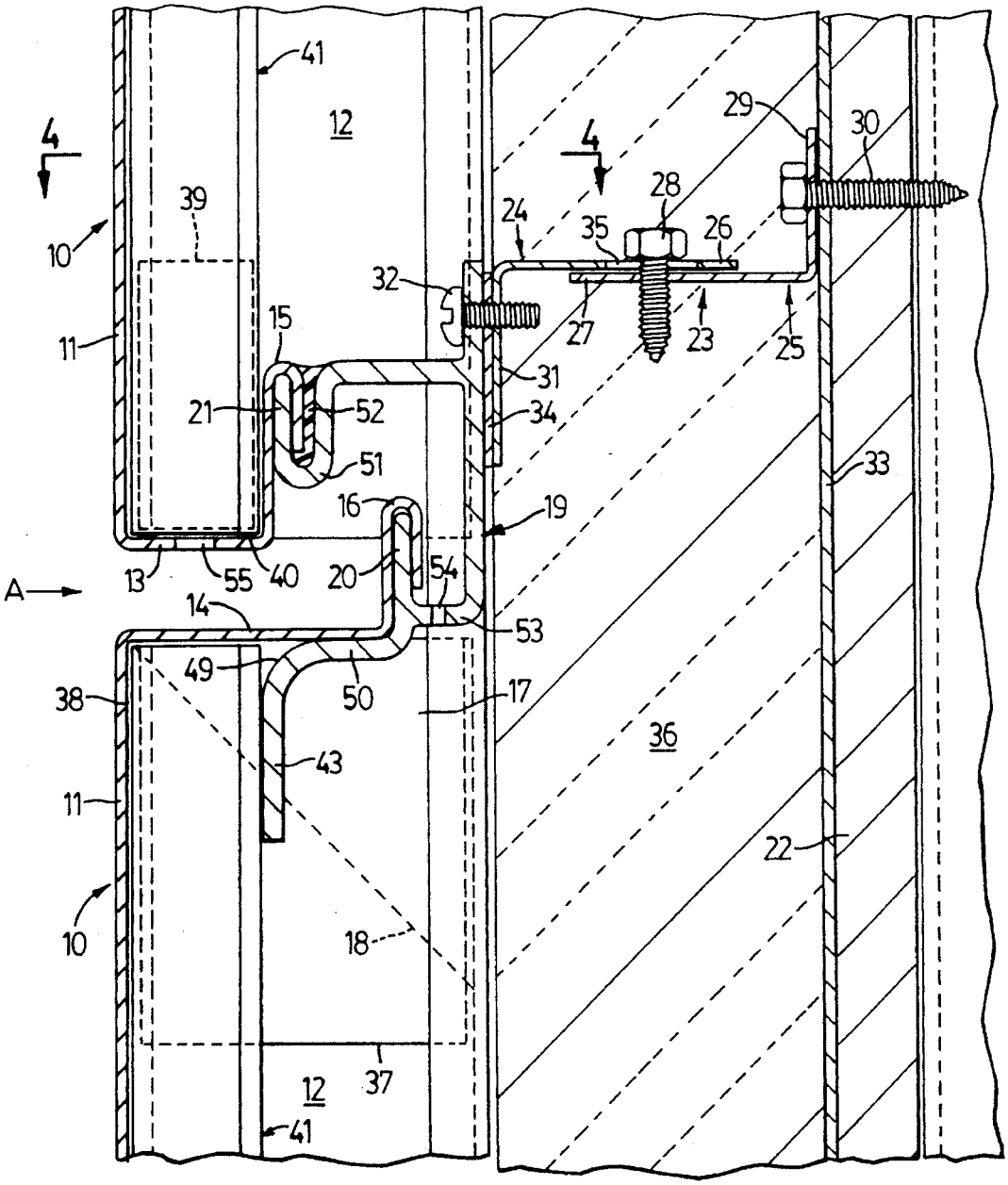
FIG. 2 is a sectioned view on an enlarged scale on the line 2—2 in FIG. 1.

As shown in FIG. 2, the hook 16 extends above the level of the lower portion 13 of the upwardly adjacent panel 10 so that by viewing between the upper portion 14 of the panel 10 and the lower portion 13 of the upwardly adjacent panel 10 in the direction of the arrow A a neat and clean appearance is presented.

If one of the panels 10 becomes damaged or otherwise requires to be replaced the panel 10 can readily and easily be removed, without requiring special skills and without the use of any tools, by vertically raising the panel 10 until the hook 15 is disengaged from the upstanding rib 21 and the hook 16 is disengaged from the upstanding rib 20. The panel 10 is then moved outwardly to position the hook 16 outwardly of the upstanding rib 20 and the hook 15 outwardly of the upstanding rib 21, after which the panel 10 is lowered and is outwardly withdrawn, the lower edge portion of the panel 10 during this operation being outwardly withdrawn in advance of the upper edge portion of the panel 10 so that the panel 10 is slightly angled to permit the passage of the hook 16 under the lower portion 13 of the upwardly adjacent panel 10. Preferably the outer edge portion 49 of an outwardly projecting horizontal flange 50 of the support 19 and which continues into the outer flange 43 is downwardly curved to facilitate this passage of the hook 16 under the lower portion 13 of the upwardly adjacent panel 10. To mount a panel 10 the above-described operations are performed in reverse and in the reverse sequence.

Thus, the panel mounting structure of the present invention permits a panel 10 which has, for example, been damaged to be replaced without disturbing any of the adjacent panels 10.

The upstanding rib 21 is preferably constituted by a free limb of an upwardly open channel member 51 of the support 19, and prior to the mounting of a panel 10 silicone sealant 52 may be disposed within the channel member 51 with the free limb of the hook 15 being embedded within this silicone sealant 52 when the panel 10 is mounted.

As shown in FIG. 2, the upstanding rib 20 may constitute a free limb of an upwardly open channel member having a web 53 in which one or more weep holes 54 are provided, and one or more further weep holes 55 may be provided in the lower portion 13 of the panel 10 which with the adjacent outer portion 11 and the hook 15 constitutes a trough, any rain water or the like being free to drain through the weep holes 54 and hence across the channel member 51 and out the weep holes 55.

I claim:

1. A panel mounting structure comprising a plurality of vertically adjacent panels each having an upper edge portion and a lower edge portion, supports each of which is for mounting the upper edge portion of one of the panels and the lower edge portion of the upwardly adjacent panel, with each support having a vertically extending panel upper edge engagement member and a vertically extending panel lower edge engagement member, said upper edge portion of said one of the panels having a vertically extending support engagement member which is vertically movable by vertical movement of said one of the panels into and out of engagement with said panel upper edge engagement member of the support without vertical movement of the upwardly adjacent panel, said lower edge portion of the upwardly adjacent panel having a vertically extending support engagement member which is vertically movable by vertical movement of the upwardly adjacent panel into and out of engagement with said panel lower edge engagement member of the support without vertical movement of said one of the panels, thereby to provide said mounting on the support of the upper edge portion of said one of the panels and the lower edge portion of the upwardly adjacent panel, with the upper edge portion and the lower edge portion of each panel being so mountable on the respective supports without disturbing the mounting of the vertically adjacent panels, and the support engagement member of the upper edge portion of said one of the panels extending above the lower edge of the upwardly adjacent panel.

2. A panel mounting structure according to claim 1, wherein the panel upper edge engagement member and the panel lower edge engagement member of each support, each comprises an upstanding rib, and the support engagement members of the upper edge portion of said one of the panels and of the lower edge portion of said upwardly adjacent panel each comprises a downwardly open hook which is in engagement with the respective upstanding rib.

3. A panel mounting structure according to claim 2, wherein each support comprises an upwardly open channel member having a free limb, the upstanding rib which comprises the panel lower edge engagement member of the support being constituted by said free limb, and silicone sealant being disposed within the channel member.

4. A panel mounting structure according to claim 2, wherein each support comprises an upwardly open channel member having a free limb and a web, the upstanding rib which comprises the panel upper edge engagement member of the support being constituted by said free limb, and at least one weep hole being provided in the web of said channel member.

5. A panel mounting structure according to claim 4, wherein the lower edge of each panel comprises a trough, with at least one weep hole being provided in the trough.

6. A panel mounting structure according to claim 1, wherein each panel has an inner face, and at least one vertically disposed stiffener is secured to the inner face of the panel, each support comprising an outer flange against which the respective stiffener is in abutting contact.

7. A panel mounting structure according to claim 6, wherein the stiffener is of top hat shape in transverse cross-section.

8. A panel mounting structure according to claim 1, wherein each support comprises an outwardly projecting horizontal flange having an outer edge portion which is downwardly curved.

* * * * *